US011147396B2

(12) United States Patent
McMillan et al.

(10) Patent No.: US 11,147,396 B2
(45) Date of Patent: Oct. 19, 2021

(54) DISPLAY SHELF SYSTEM

(71) Applicant: Moët Hennessy USA, Inc., New York, NY (US)

(72) Inventors: Stacy Lyn McMillan, Danville, CA (US); Steven Michael McKechnie, Torrance, CA (US); Kenneth Tozer, Bonney Lake, WA (US)

(73) Assignee: Moët Hennessy USA, Inc., New York, NY (US)

( * ) Notice: Subject to any disclaimer, the term of this patent is extended or adjusted under 35 U.S.C. 154(b) by 0 days.

(21) Appl. No.: 16/533,690

(22) Filed: Aug. 6, 2019

(65) Prior Publication Data

US 2020/0046143 A1 Feb. 13, 2020

Related U.S. Application Data

(60) Provisional application No. 62/716,322, filed on Aug. 8, 2018.

(51) Int. Cl.

| | |
|---|---|
| ***A47F 5/00*** | (2006.01) |
| ***A47F 3/14*** | (2006.01) |
| ***A47F 5/10*** | (2006.01) |
| ***A47F 7/28*** | (2006.01) |
| ***A47B 96/02*** | (2006.01) |
| *A47F 3/04* | (2006.01) |

(52) U.S. Cl.

CPC ..... *A47F 5/0043* (2013.01); *A47B 96/024* (2013.01); *A47F 3/14* (2013.01); *A47F 5/0018* (2013.01); *A47F 5/105* (2013.01); *A47F 7/28* (2013.01); *A47F 3/0486* (2013.01)

(58) Field of Classification Search

CPC ..... A47F 5/0043; A47F 5/105; A47F 5/0018; A47F 3/14; A47F 7/28; A47F 3/0486; A47B 96/024

See application file for complete search history.

(56) References Cited

U.S. PATENT DOCUMENTS

| | | | | | |
|---|---|---|---|---|---|
| 3,252,614 | A * | 5/1966 | Evans | B65D 21/0212 | 206/509 |
| 3,407,939 | A * | 10/1968 | Villar-Kelly | A47K 5/02 | 211/90.01 |
| 3,730,108 | A * | 5/1973 | Stroh | A47B 45/00 | 108/108 |
| 3,744,868 | A * | 7/1973 | Reiter | A47B 47/06 | 312/263 |
| 4,160,570 | A * | 7/1979 | Bridges | A47F 3/00 | 312/245 |
| 4,228,906 | A * | 10/1980 | Jones | A47F 5/0025 | 211/88.01 |
| 4,546,889 | A * | 10/1985 | Schoumaker | E04B 2/7444 | 211/105.3 |
| 4,773,348 | A * | 9/1988 | Rowley | E02B 3/26 | 114/219 |
| 4,947,999 | A * | 8/1990 | Warp | A47B 96/00 | 108/901 |
| 5,009,380 | A * | 4/1991 | Fee | F16M 13/022 | 248/214 |
| 5,080,452 | A * | 1/1992 | Tuckman | A47B 63/00 | 206/214 |

(Continued)

*Primary Examiner* — Ko H Chan

(74) *Attorney, Agent, or Firm* — Steptoe & Johnson LLP

(57) ABSTRACT

A display shelf system includes mounting support members that hook onto a rail that attaches to a display cabinet.

12 Claims, 11 Drawing Sheets

(56) References Cited

U.S. PATENT DOCUMENTS

D323,767 S * 2/1992 Polski ..... D7/620
5,148,755 A * 9/1992 Morales ..... A47B 23/02 108/46
5,309,686 A * 5/1994 Underwood ..... A47B 83/001 160/135
5,454,638 A * 10/1995 Bird ..... A47B 57/42 108/108
5,472,103 A * 12/1995 Merl ..... A47B 47/022 211/187
5,472,164 A * 12/1995 Contee, Jr. ..... A47J 37/0786 126/25 R
5,590,607 A * 1/1997 Howard ..... A47B 21/0314 108/135
5,665,304 A * 9/1997 Heinen ..... A47F 1/126 108/110
5,667,119 A * 9/1997 Florence ..... B60N 3/004 224/281
5,924,615 A * 7/1999 McGarrah ..... B60R 9/00 220/482
5,951,129 A * 9/1999 Stein ..... B25H 3/00 206/373
D415,995 S * 11/1999 Kanehl, Jr. ..... D12/416
6,095,057 A * 8/2000 Corban ..... B25H 3/06 108/152
6,095,388 A * 8/2000 Neville, Sr. ..... B60R 7/12 211/62
6,119,996 A * 9/2000 Connery ..... A47D 15/00 248/311.2
6,422,399 B1 * 7/2002 Castillo ..... A47B 57/40 211/175
6,481,678 B1 * 11/2002 Chong ..... H02G 3/288 211/192
6,536,609 B2 * 3/2003 Lake ..... A47F 1/126 211/59.3
6,837,383 B1 * 1/2005 McElhaney, Jr. ..... B25H 5/00 206/373
7,128,223 B1 * 10/2006 Sarnoff ..... A47F 5/083 211/90.03
7,527,156 B2 * 5/2009 Wisnoski ..... A47F 5/0846 211/103
7,530,329 B1 * 5/2009 Paris, Sr. ..... A01K 1/0356 119/61.57
7,992,714 B1 * 8/2011 Devault ..... A47G 19/10 206/564
8,152,005 B2 * 4/2012 Barkdoll ..... A47F 5/0025 211/88.01
8,167,256 B1 * 5/2012 Bishop ..... F16M 13/02 248/200
8,177,311 B2 * 5/2012 Apgood, II ..... A47F 5/0846 312/245
8,720,702 B2 * 5/2014 Nagel ..... A47B 96/027 211/59.3
8,789,712 B2 * 7/2014 Johnson ..... A47F 5/0025 211/71.01
9,016,484 B2 * 4/2015 Kologe ..... A47F 1/125 211/59.3
9,339,125 B1 * 5/2016 Floersch ..... A47F 3/002
9,468,312 B2 * 10/2016 Denby ..... A47F 5/0043
10,334,970 B2 * 7/2019 Buck ..... A47B 96/1441
2012/0228300 A1 * 9/2012 Wertman ..... A47B 96/027 220/476

* cited by examiner

DISPLAY SHELF SYSTEM

CLAIM OF PRIORITY

This application claims the benefit of prior U.S. Provisional Application No. 62/716,322 filed on Aug. 8, 2018, each of which is incorporated by reference in its entirety.

TECHNICAL FIELD

This invention relates to a display shelf system for commercial items, for example, bottles in a refrigerated display case.

BACKGROUND

Refrigerated display cabinets can be configured to sell refrigerated items.

SUMMARY

In one aspect, a display shelf system can include an open front shelf, the shelf including a bottom panel, a right side panel, a left side panel, a top panel, and a back region, the open front shelf including a front lip portion adjacent to the open front, and a pair of mounting support members secured to the back region of the open front shelf. Each support member can include a top hook portion adjacent to the top panel and having a first depth region extending away from the back region and a catch region extending downward toward the bottom panel and a bottom support portion having a second depth region extending away from the back region adjacent to the bottom panel. The system can include a rail including a first latching region and a second latching region, wherein the rail has a top edge, a bottom edge and a length separating the first latching region and the second latching region, the top hook portion fitting over the top edge with the bottom support portion extending beyond the bottom edge.

In another aspect, a display shelf can include an open front shelf, the shelf including a bottom panel, a right side panel, a left side panel, a top panel, and a back region, the open front shelf including a front lip portion adjacent to the open front, and a pair of mounting support members secured to the back region of the open front shelf. Each support member can include a top hook portion adjacent to the top panel and having a first depth region extending away from the back region and a catch region extending downward toward the bottom panel. The shelf can include a bottom support portion that can have a second depth region extending away from the back region adjacent to the bottom panel.

In certain circumstances, the second depth region of the bottom support portion can be adjustable.

In certain circumstances, the length of the rail can be adjustable.

In certain circumstances, the first latching region and the second latching region each can include a fixed top hooked portion and a bottom hooked portion.

In certain circumstances, the bottom hooked portion can be adjustable relative to the fixed top hooked portion.

In certain circumstances, the front lip portion can cover less than half of the open front.

In certain circumstances, open front can angle toward the back region from the bottom panel to the top panel.

In certain circumstances, the bottom panel can include a cushioned surface.

In certain circumstances, a portion of the shelf can be a metal.

In certain circumstances, a portion of the shelf can be a plastic.

The details of one or more embodiments are set forth in the accompanying drawings and the description below. Other features, objects, and advantages of the invention will be apparent from the description and drawings, and from the claims.

DETAILED DESCRIPTION

Figure 1:
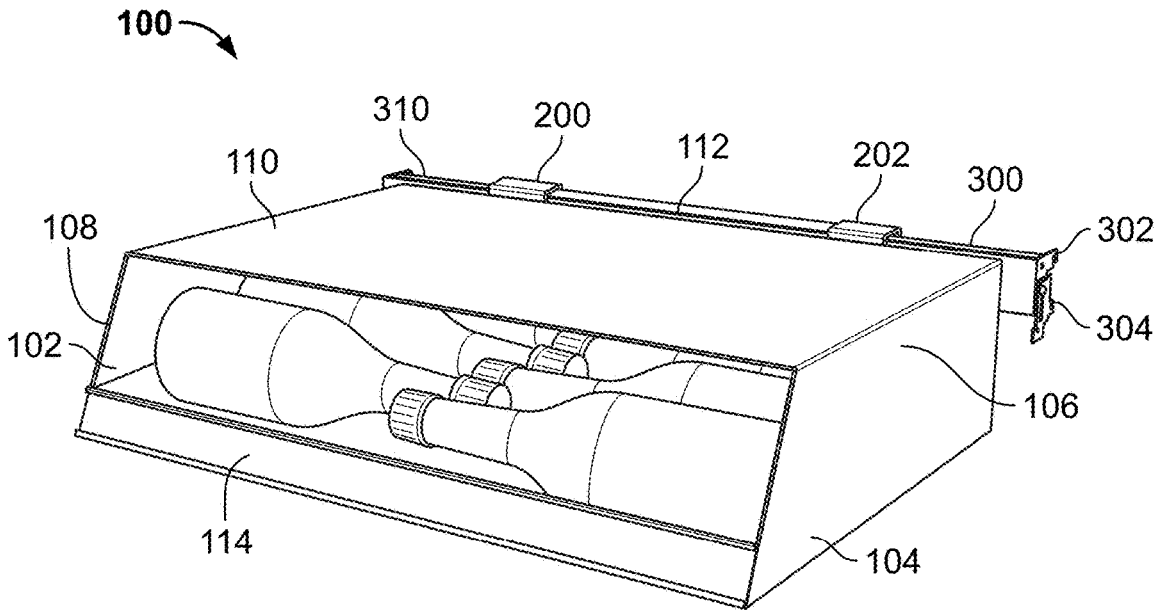
FIG. 1 illustrates a front perspective view of a display shelf.
Figure 2:
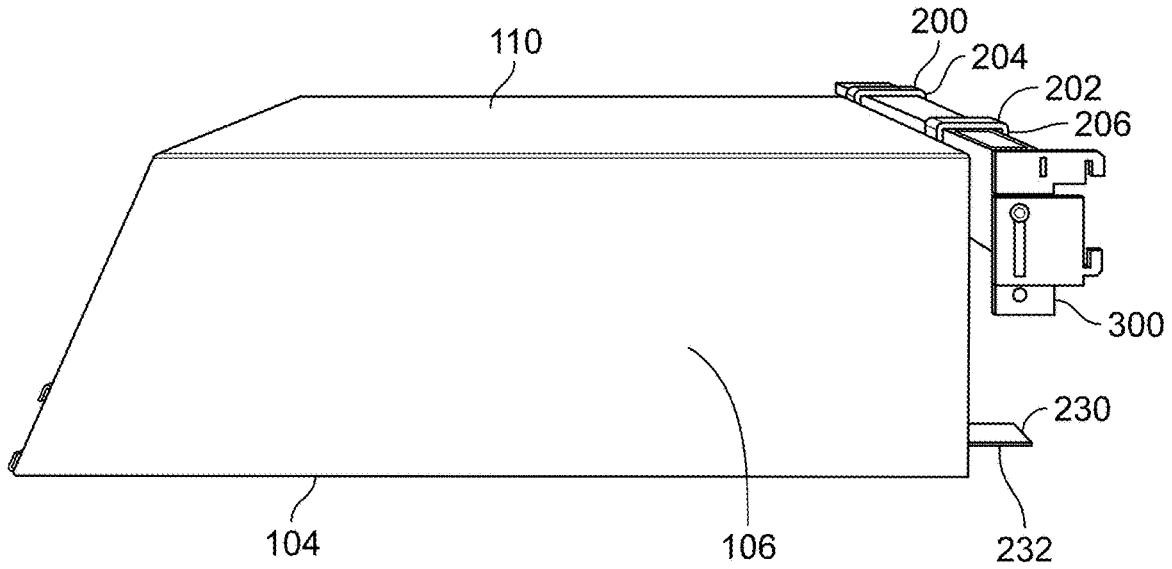
FIG. 2 illustrates a side view of a display shelf.
Figure 3:
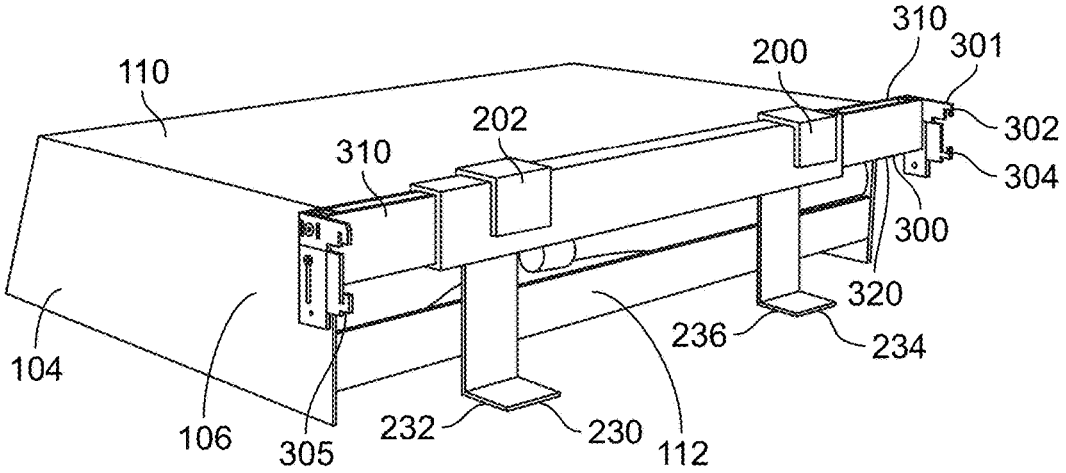
FIG. 3 illustrates a rear perspective view of a display shelf.

Display cabinets, such as refrigerated display cabinets, contain shelving units to display content. These shelves can hold objects on top of the shelf only. The display shelf system described herein has a top that can support items placed on the unit as a shelf and an enclosed bottom section configured to hold additional items. Specifically, the bottom section has an opening in the front and a lip that constrains the contents of the bottom section in the enclosed bottom section. In certain embodiments, the contents of the bottom section are bottles, for example, bottles of champagne.

Referring to FIGS. 1-10, a display shelf 100 can include an open front shelf 102. Shelf 102 can have a bottom panel 104, a right side panel 106, a left side panel 108, a top panel 110, and a back region 112. The open front shelf 102 can include a front lip portion 114 adjacent to the open front 102. Display shelf 100 includes a pair of mounting support members 200, 202. Support members 200, 202 are secured to the back region 112 of the open front shelf 102.

Each of bottom panel 104, right side panel 106, left side panel 108, top panel 110, and back region 112, independently, can be a solid planar surface or a solid planar surface with one or more openings.

Each support member 200 or 202 can include a top hook portion 204 or 206 adjacent to top panel 110. Top hook portion 204 or 206 can have a first depth region 220 or 222 extending away from back region 112 and a catch region 224 or 226 extending downward toward bottom panel 104.

Each support member 200 or 202 can include a bottom support portion 230 or 234 having a second depth region 232 or 236 extending away from back region 112 adjacent to bottom panel 104.

The display shelf can be part of a display shelf system. The components of the system include display shelf 100 and rail 300. The shelf and rail, together, can be used to form the functioning display shelf for use in a display case.

Referring to FIGS. 1-10, rail 300 can include a first latching region 301 and a second latching region 305. Rail 300 has a top edge 310, a bottom edge 312 and a length L separating the first latching region 301 and the second latching region 305. The top hook portion 220 or 222 of each respective top hook portion fits over the top edge 310 with the bottom support portion 232 or 236 of each respective bottom support portion extends beyond the bottom edge 312. This arrangement provides support for the shelf by creating a cantilevered configuration of contact points when the shelf is mounted on the rail on a surface of, for example, a display cabinet.

Figure 4:
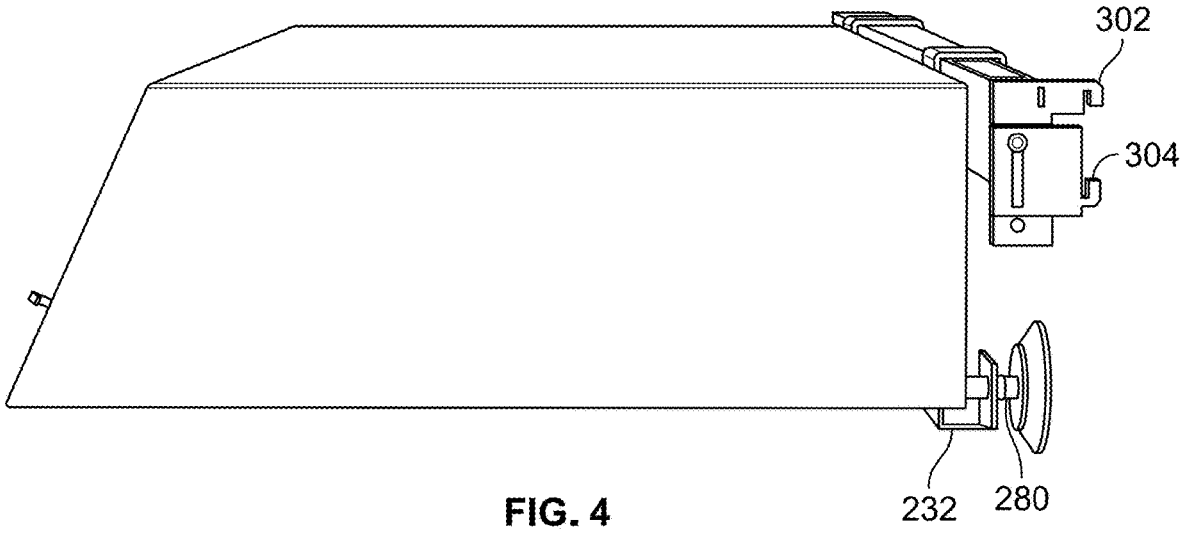
FIG. 4 illustrates a side view of a display shelf.
Figure 5:
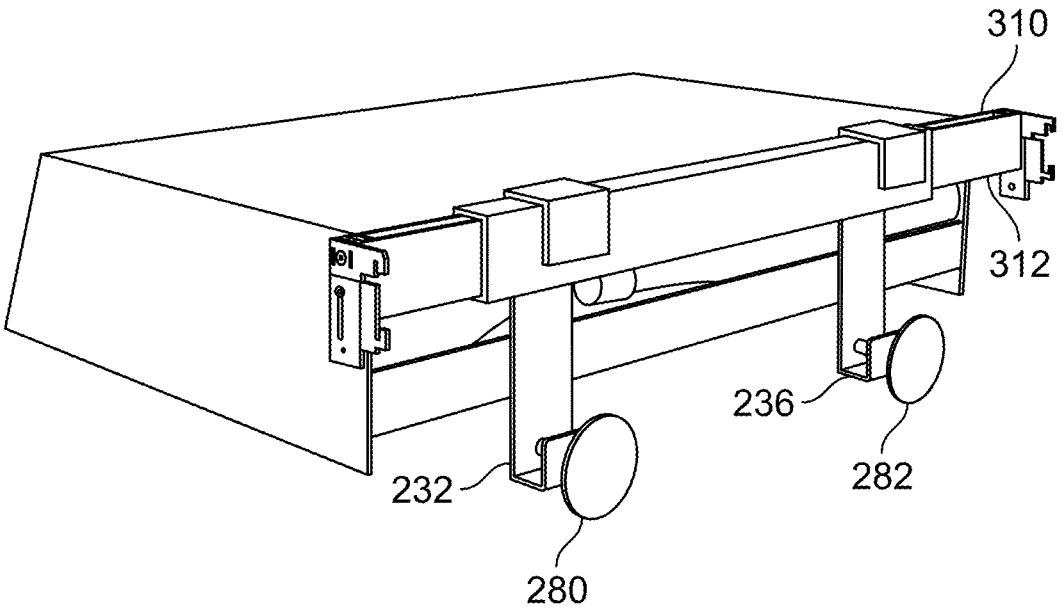
FIG. 5 illustrates a rear perspective view of a display shelf.
Figure 6:
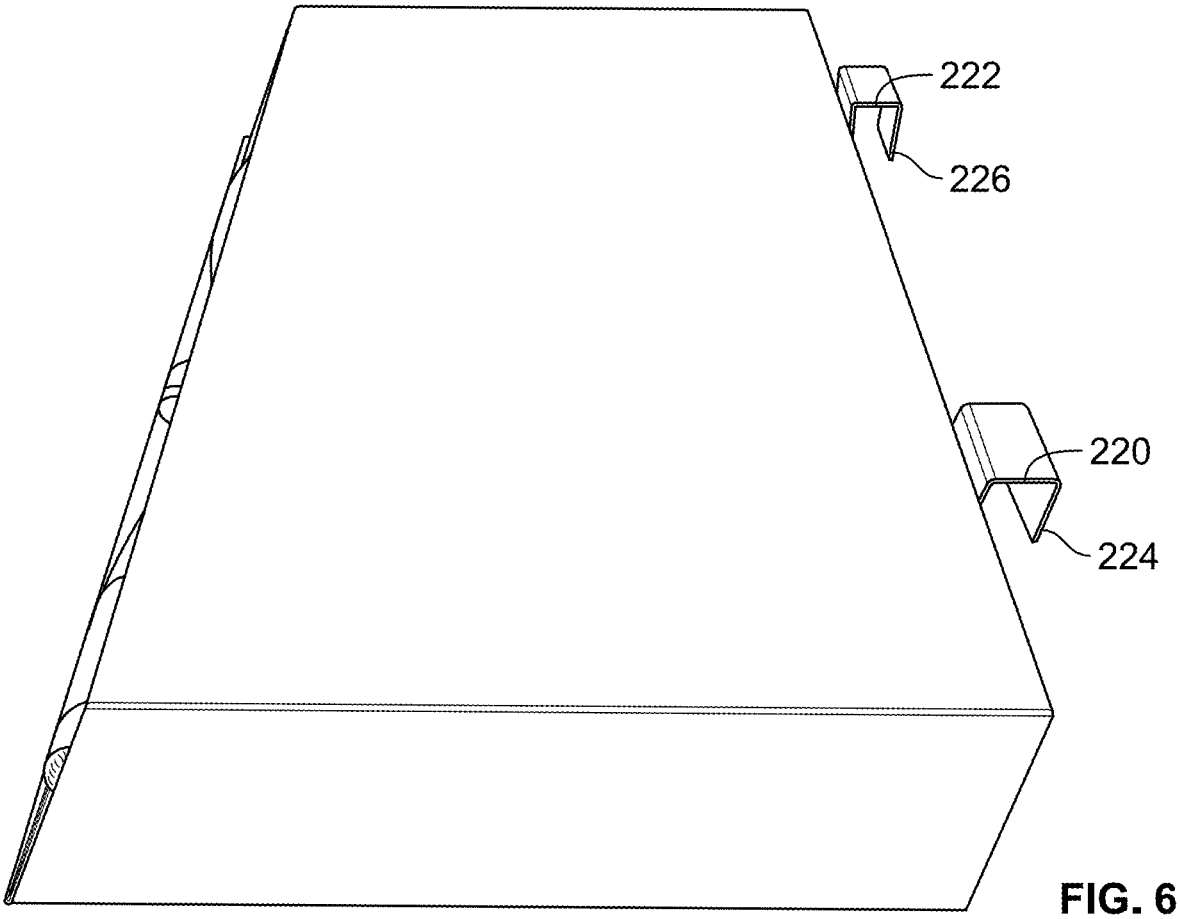
FIG. 6 illustrates a top perspective view of a display shelf.
Figure 7:
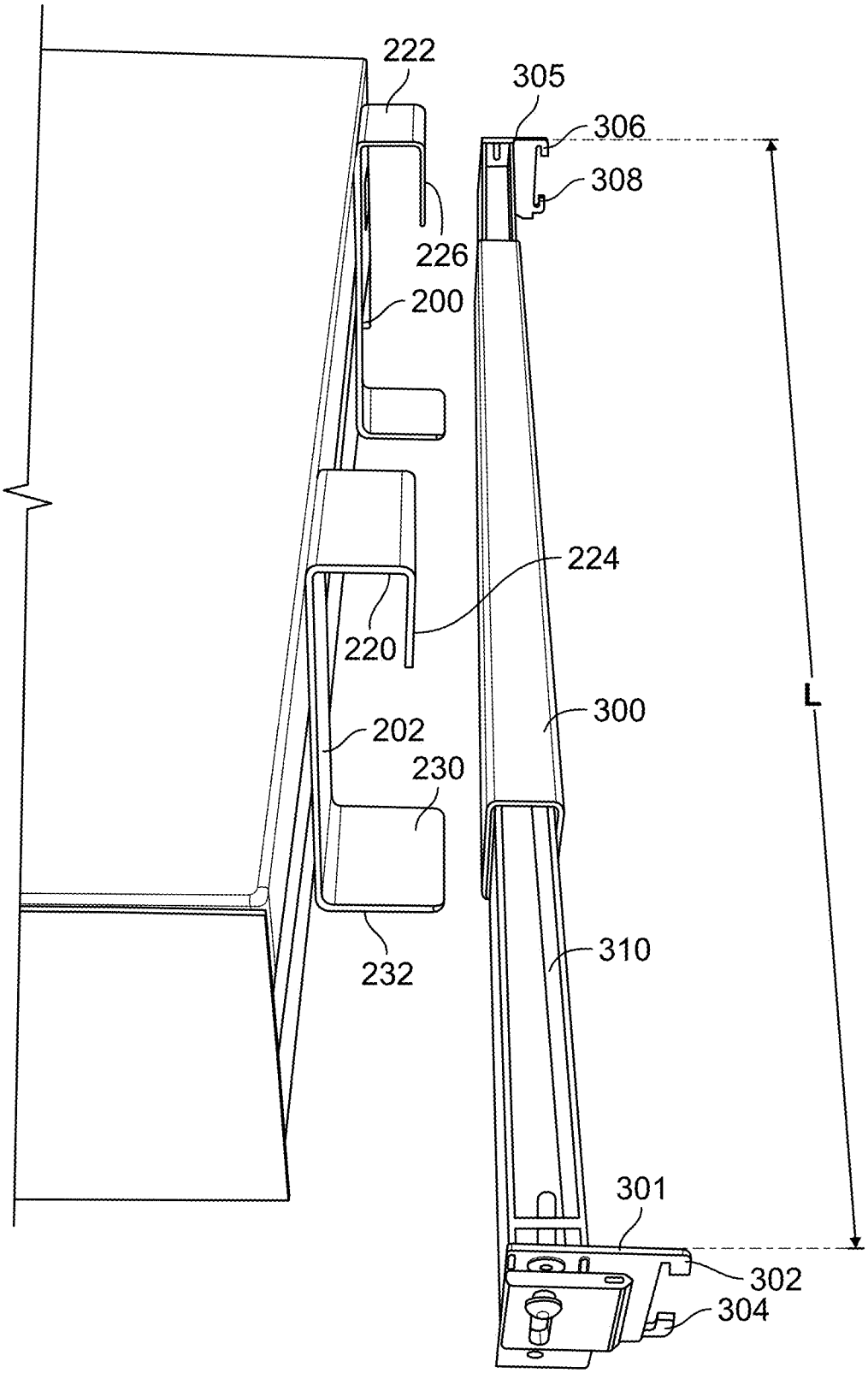
FIG. 7 illustrates a view of a display shelf and a support rail.

Referring to FIGS. 4 and 5, bottom support portion 232 or 236 can include an adjustable foot 280 or 282. The adjustable foot can be used to modify the length of the bottom support portion to accommodate different cabinet configurations.

Figure 8:
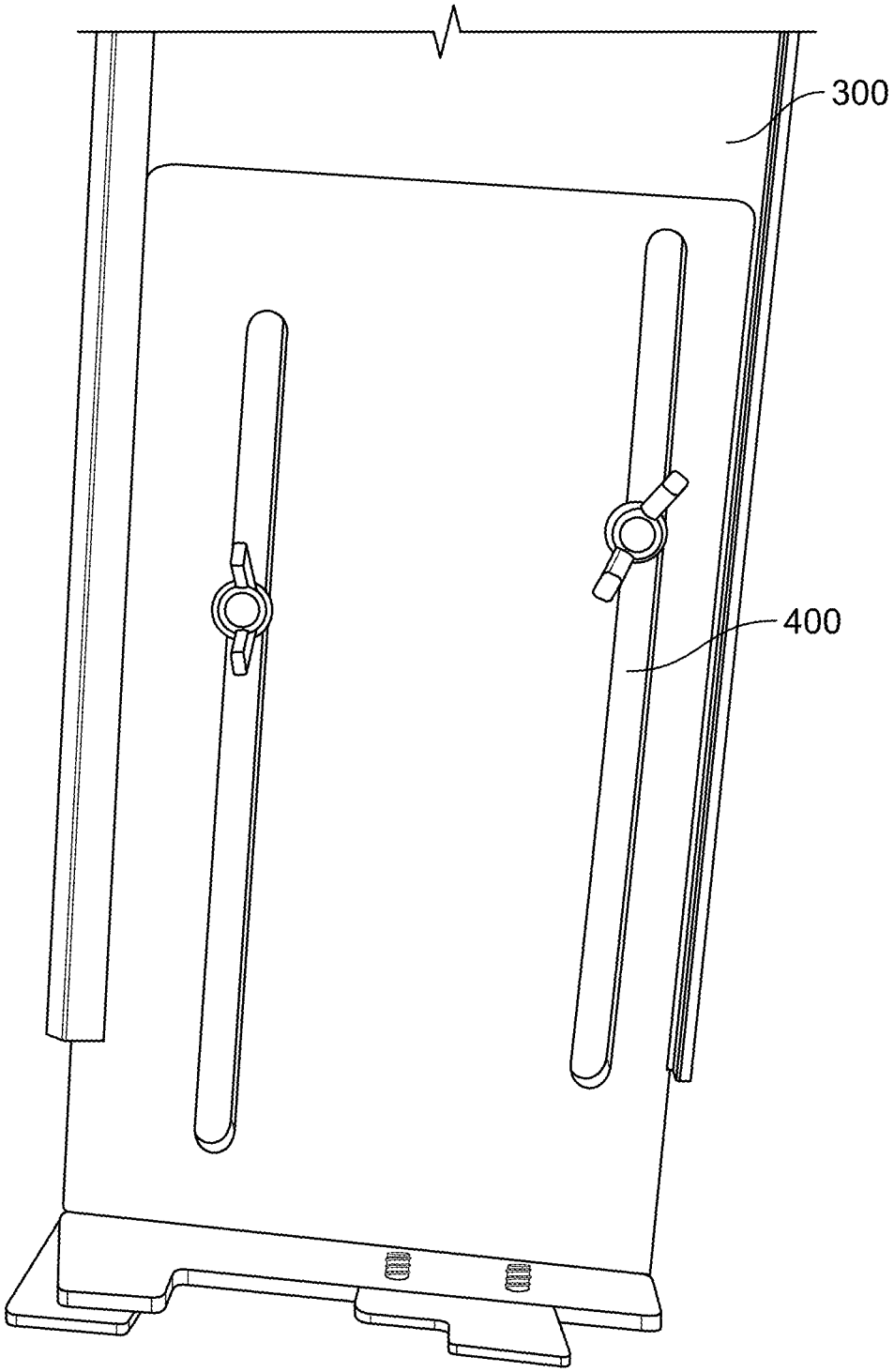
FIG. 8 illustrates a view of an end of a support rail.
Figure 9:
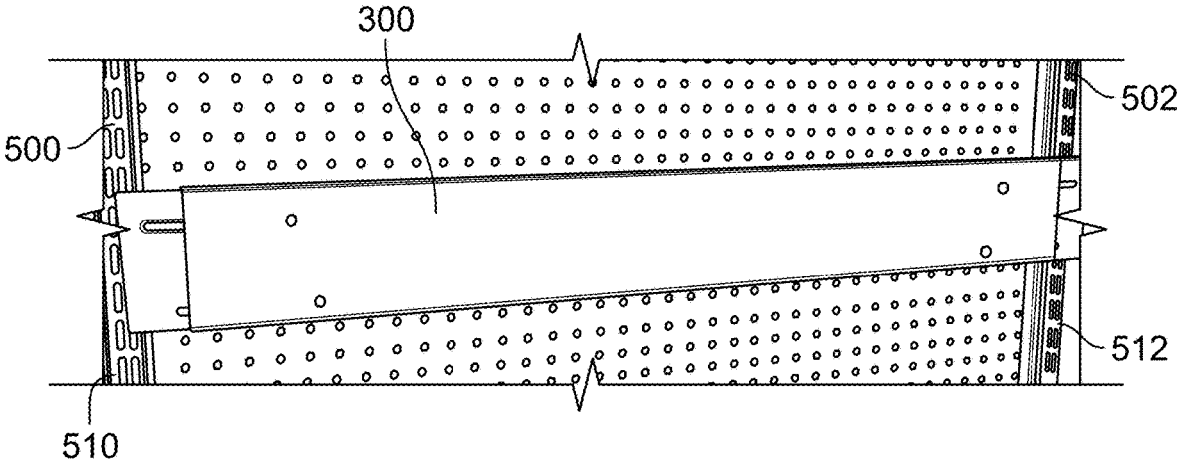
FIG. 9 illustrates a view of a support rail mounted in a cabinet.
Figure 10:
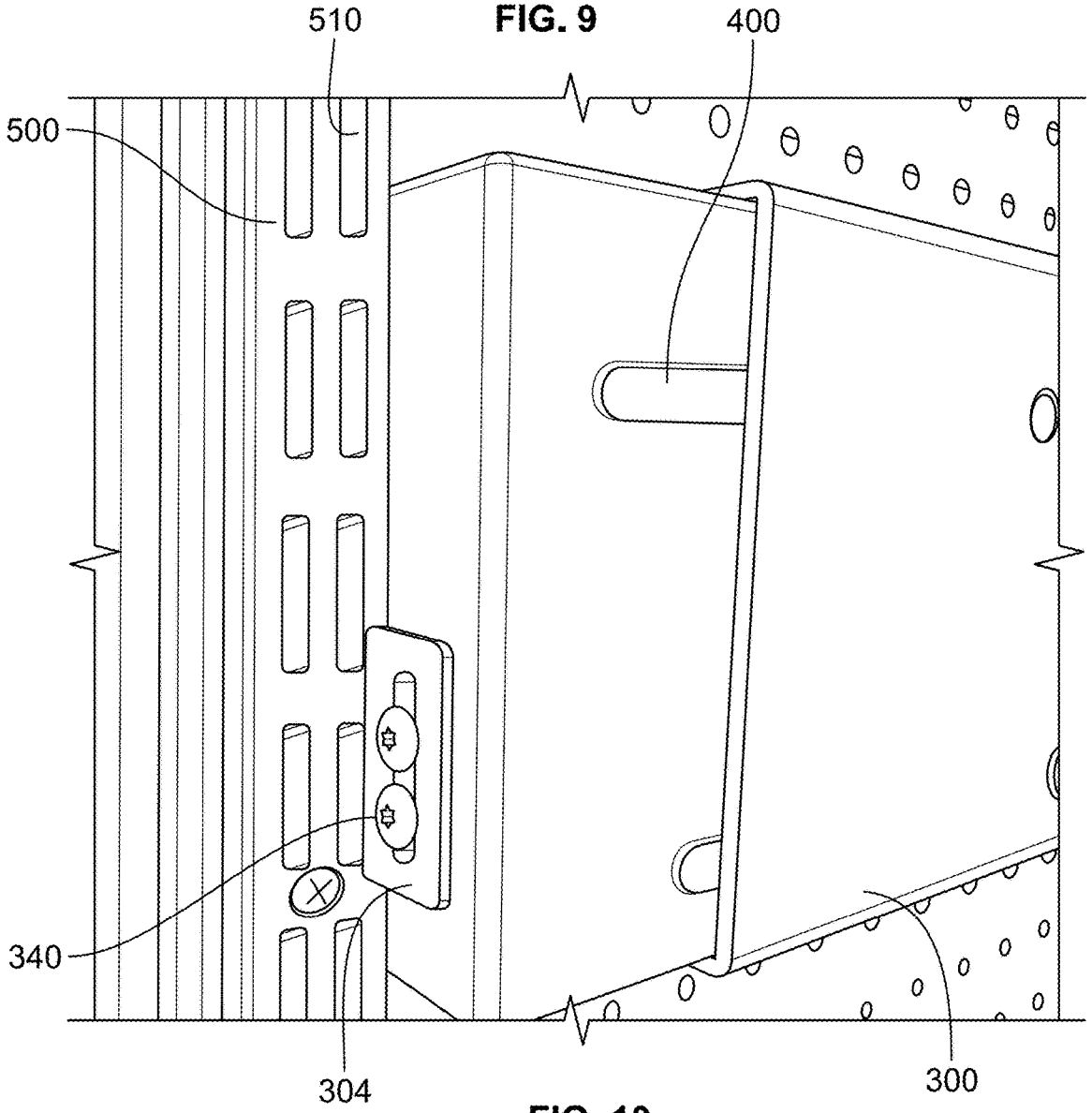
FIG. 10 illustrates a view of an end of a support rail.
Figure 11:
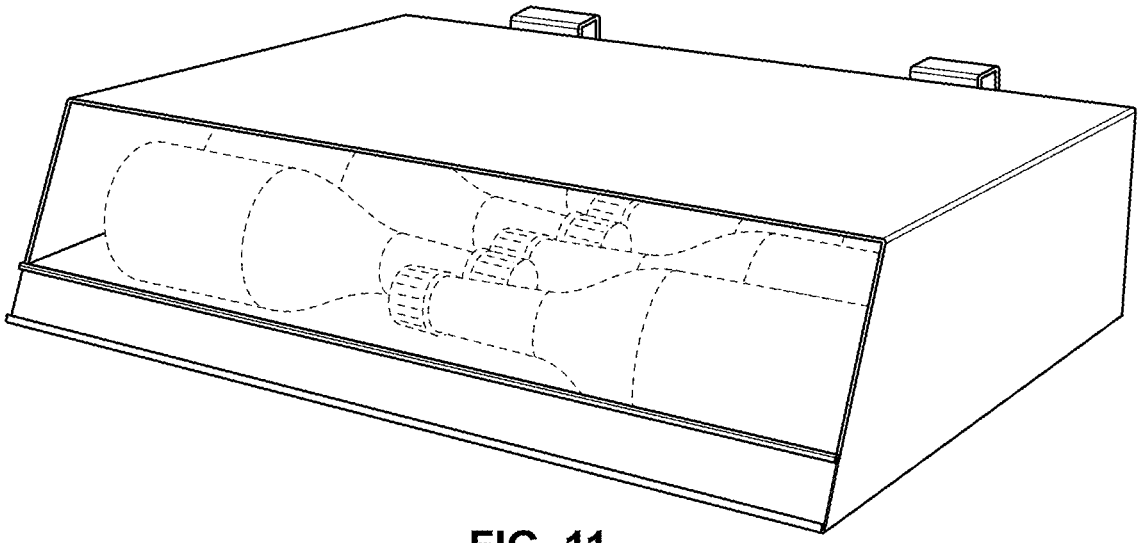
FIG. 11 illustrates a front perspective view of a display shelf.
Figure 12:
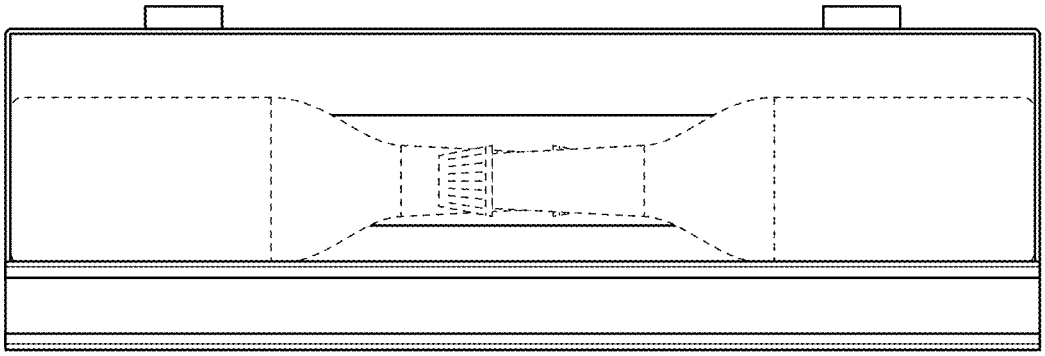
FIG. 12 illustrates a front view of a display shelf.
Figure 13:
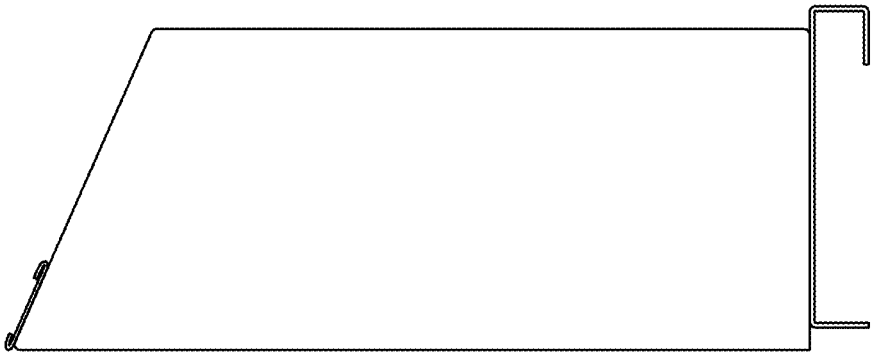
FIG. 13 illustrates a right side view of a display shelf.
Figure 14:
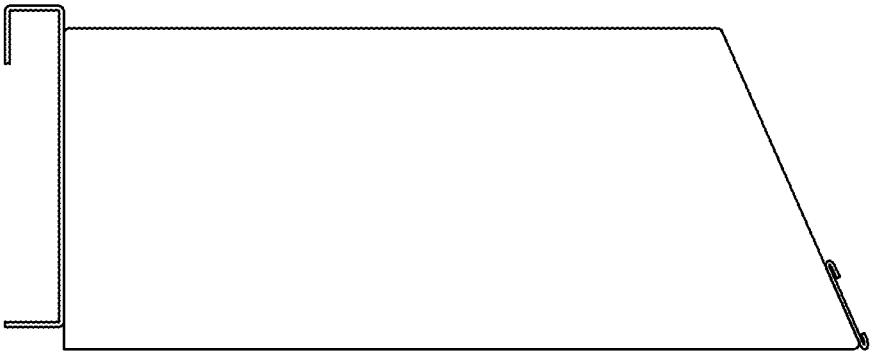
FIG. 14 illustrates a left side view of a display shelf.
Figure 15:
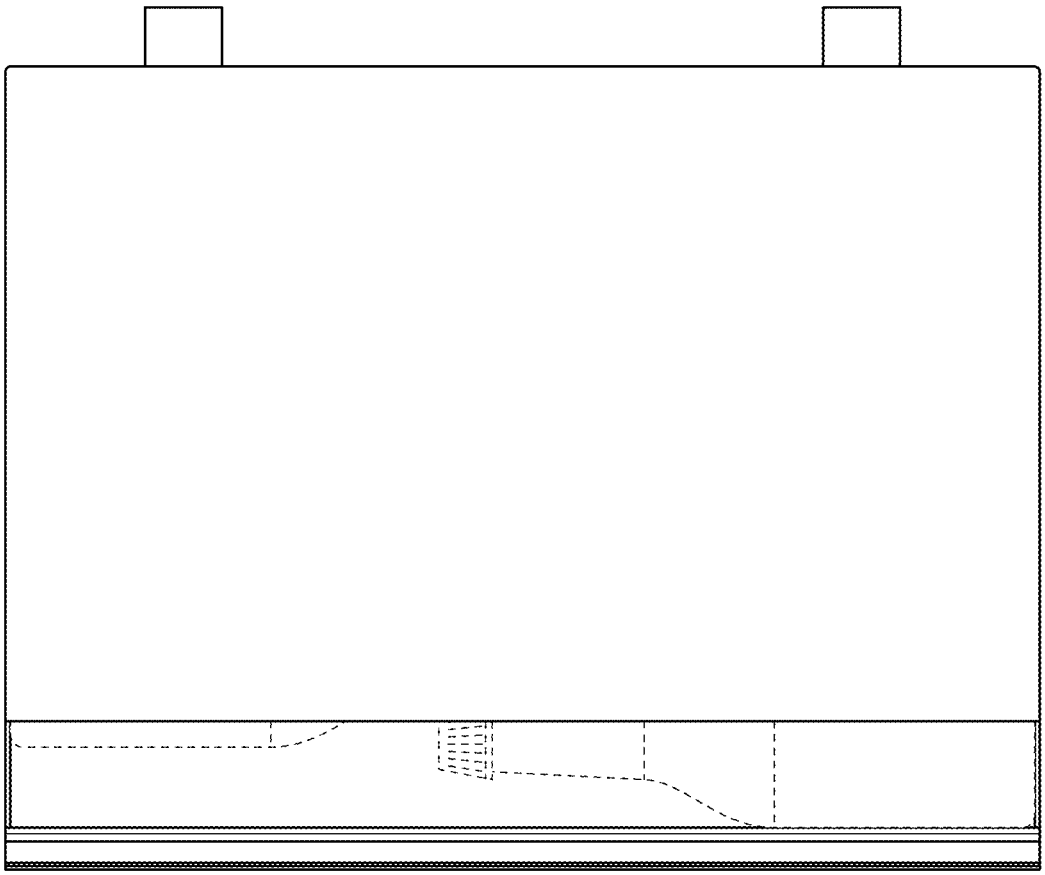
FIG. 15 illustrates a top view of a display shelf.
Figure 16:
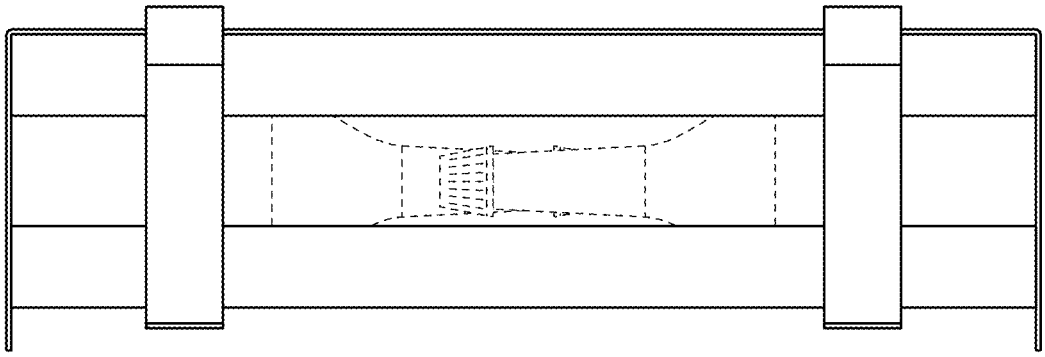
FIG. 16 illustrates a rear view of a display shelf.
Figure 17:
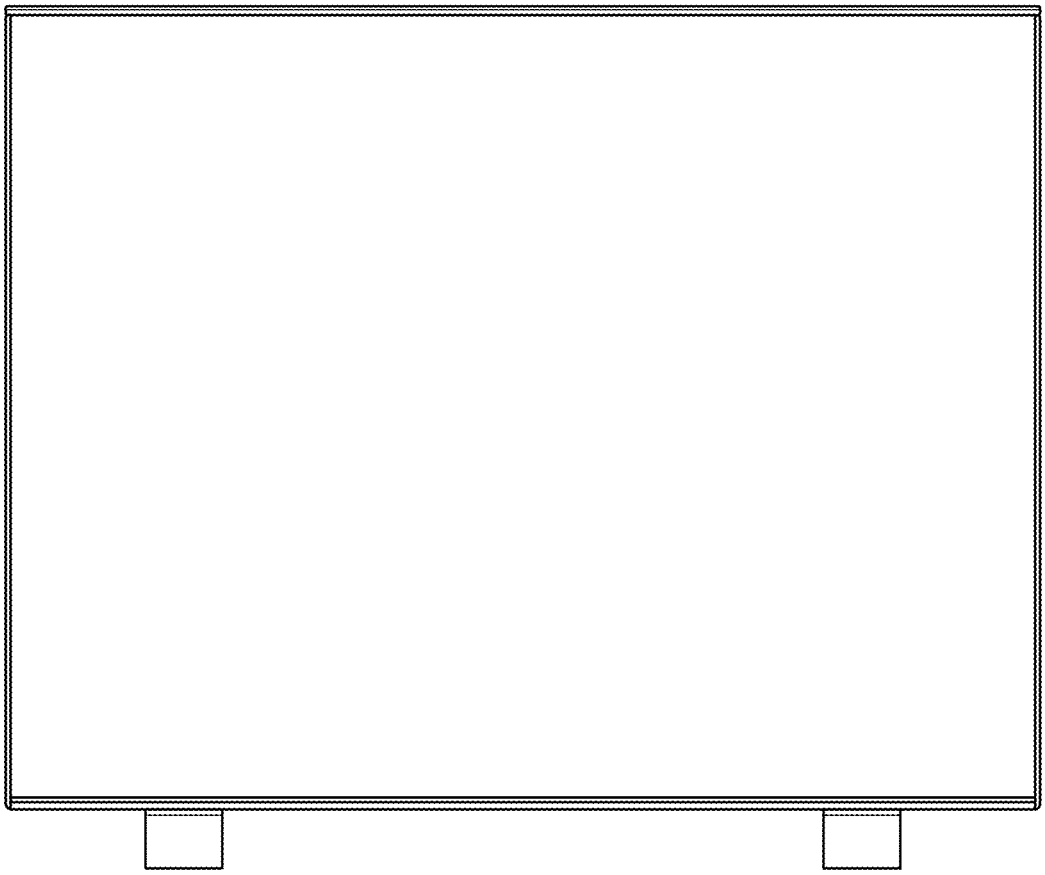
FIG. 17 illustrates a bottom view of a display shelf.

Referring to FIGS. 8 and 10, length L of rail 300 can be adjustable. For example, a securable sliding region 400 can allow length L to be adjusted so that the shelf system can be used in different cabinet configurations.

Referring to FIGS. 1-4, 7 and 10, the first latching region 301 and the second latching region 305 can each include a fixed top hooked portion 302 and a bottom hooked portion 304. In certain embodiments, the bottom hooked portion 304 can be adjustable relative to the fixed top hooked portion 304 using slots and screws 340 to fix the position of bottom hooked portion 304.

In certain embodiments, the front lip portion covers less than half of the open front. This configuration holds bottles inside the shelf. The shelf can accommodate up to 10 bottles of, for example, champagne. Thus, the display shelf can accommodate weight inside and on top of the shelf. The load tolerance of the shelf can be up to 60 pounds. For example, the weight one champagne bottle can be about 3.5 lbs. When the shelf is loaded with six bottles weighs approximately 21 lbs. If the shelf is also carrying a floral arrangement, the additional weight is about 10 lbs per floral arrangement. Thus, the shelf can hold, for example, up to four floral arrangements and six champagne bottles. The weight of the shelf without additional load can be about 25 lbs.

In certain embodiments, the open front angles toward the back region from the bottom panel to the top panel. This structure allows for more direct access to the contents in the shelf, which can facilitate loading and unloading of materials from the interior portion of the shelf.

In certain embodiments, the bottom panel can include a cushioned surface. The cushioned surface can reduce rattling of bottles and reduce breakage. The cushioned surface can be a rubber material or thin polymeric foam material.

In certain embodiments, the components of the shelf can be made of a metal, a plastic, or combinations thereof.

Each panel can be in the shape of a square, hexagon, rectangle, triangle, parallelogram, rhombus, or any suitable polygon.

In some embodiments, the rail is configured to attach to a mounting system in a refrigerated cabinet. The mounting system can be an adjustable shelving system having a track with periodic grooves to engage hooks from the rail latching region. The track can have slots at regular intervals. The adjustable shelving system can have two or more vertical tracks. The length of the rail between the first latching region and the second latching region can optionally be adjusted to match the vertical tracks in the refrigerated cabinet. For example, referring to FIGS. 9 and 10, the hooks of the latching region can engage in grooves 510 of track 500.

Referring to FIGS. 11-17, various views of the display shelf are shown.

While the invention has been shown and explained in the embodiment described herein, it is to be understood that the invention should not be confined to the exact showing of the drawings, and that any variations, substitutions, and modifications are intended to be comprehended within the spirit of the invention. Other embodiments are within the claims.

What is claimed is:

1. A display shelf system comprising:

an open front shelf, the shelf including a bottom panel, a right side panel, a left side panel, a top panel, and a back region, the open front shelf including a front lip portion adjacent to the open front, wherein the front lip portion covers less than half of the open front, wherein the bottom panel includes a cushioned surface;

a pair of mounting support members secured to the back region of the open front shelf, each support member including:

a top hook portion adjacent to the top panel and having a first depth region extending away from the back region and a catch region extending downward toward the bottom panel;

a bottom support portion having a second depth region extending away from the back region adjacent to the bottom panel and a foot portion extending toward the top hook portion; and an adjustable foot on the foot portion, wherein the second depth region of the bottom support portion is adjustable via the adjustable foot; and a rail including a first latching region and a second latching region, wherein the rail has a top edge, a bottom edge and an adjustable length separating the first latching region and the second latching region, the top hook portion fitting over the top edge with the bottom support portion extending beyond the bottom edge.

2. The display shelf system of claim 1, wherein the first latching region and the second latching region each include a fixed top hooked portion and a bottom hooked portion.

3. The display shelf system of claim 2, wherein the bottom hooked portion is adjustable relative to the fixed top hooked portion.

4. The display shelf system of claim 1, wherein the top panel is a load-bearing shelf.

5. The display shelf system of claim 1, wherein open front angles toward the back region from the bottom panel to the top panel.

6. The display shelf system of claim 1, comprising a metal.

7. The display shelf system of claim 1, comprising a plastic.

8. A display shelf comprising:

an open front shelf, the shelf including a bottom panel, a right side panel, a left side panel, a top panel, and a back region, the open front shelf including a front lip portion adjacent to the open front, wherein the front lip portion covers less than half of the open front;

a pair of mounting support members secured to the back region of the open front shelf, each support member including:

a top hook portion adjacent to the top panel and having a first depth region extending away from the back region and a catch region extending downward toward the bottom panel; and a bottom support portion having a second depth region extending away from the back region adjacent to the bottom panel and a foot portion extending toward the top hook portion;

an adjustable foot on the foot portion, wherein the second depth region of the bottom support portion is adjustable via the adjustable foot.

9. The display shelf of claim 8, wherein open front angles toward the back region from the bottom panel to the top panel.

10. The display shelf of claim 8, wherein the bottom panel includes a cushioned surface.

11. The display shelf of claim 8, comprising a metal.

12. The display shelf of claim 8, comprising a plastic.

* * * * *